US005817711A

United States Patent [19]

Kambe et al.

[11] Patent Number: 5,817,711

[45] Date of Patent: Oct. 6, 1998

[54] AQUEOUS WORKING LIQUID COMPOSITION FOR WIRE SAW

[75] Inventors: Takashi Kambe; Kensho Miyata; Kazuo Tanaka; Eiichi Ibe, all of Kanagawa, Japan

[73] Assignees: Nippei Toyama Corporation, Tokyo; Palace Chemical Co., Ltd., Kanagawa, both of Japan

[21] Appl. No.: 909,050

[22] Filed: Aug. 11, 1997

[30] Foreign Application Priority Data

Aug. 12, 1996 [JP] Japan ..... 8-212720

[51] Int. Cl.[6] ..... C08J 3/02; C08K 3/20; C10M 105/76

[52] U.S. Cl. ..... 524/501; 524/115; 524/155; 524/186; 524/220; 524/221; 524/313; 524/404; 524/414; 524/417; 524/433; 524/447; 524/499; 252/9; 252/11; 252/32.5; 252/49.3

[58] Field of Search ..... 524/115, 155, 524/186, 220, 221, 313, 404, 414, 417, 433, 447, 499, 501; 252/9, 11, 32.5, 49.3

[56] References Cited

FOREIGN PATENT DOCUMENTS

| | | |
|---|---|---|
| 0042286 | 6/1981 | European Pat. Off. . |
| 0686684 | 5/1995 | European Pat. Off. . |
| 0709448 | 5/1996 | European Pat. Off. . |
| 57-45794 | 9/1982 | Japan . |
| 4-216897 | 8/1992 | Japan . |
| 4-218594 | 8/1992 | Japan . |
| 8-57847 | 3/1996 | Japan . |
| 8-60176 | 3/1996 | Japan . |

OTHER PUBLICATIONS

JP 62 297 062 A (Derwent Abstract); Dec. 1987.
JP 04 218 594 A (Derwent Abstract); Aug. 1992.
JP 08 057 847 A (Derwent Abstract); Mar. 1996.
JP 2 017 801 C (Derwent Abstract); Aug. 1994.

*Primary Examiner*—Samuel A. Acquah
*Attorney, Agent, or Firm*—Sughrue, Mion, Zinn, Macpeak & Seas, PLLC

[57] ABSTRACT

An aqueous working liquid composition for a wire saw comprising the following components (A) to (E): (A) 10 to 60% by weight of at least one selected from the group consisting of polyglycol ethers represented by the following formulae (I) and (II):

$$R_1-O-(CH_2CH_2O)_n-R_2 \quad (I)$$

$$R_1-O-(CH_2\overset{\overset{\displaystyle CH_3}{|}}{C}HO)_n-R_2 \quad (II)$$

wherein $R_1$ represents a hydrogen atom, an alkyl group having 1 to 6 carbon atoms or a phenyl group; $R_2$ represents a hydrogen atom or an acetyl group; and n represents an integer of 1 to 4; (B) 0.1 to 5.0% by weight of at least one selected from the group consisting of organic bentonite and inorganic bentonite; (C) 0.01 to 5.0% by weight of at least one selected from the group consisting of carboxymethyl cellulose (CMC), MgO, methanol, and ethanol; (D) 0.1 to 2.0% by weight of at least one selected from the group consisting of a sodium β-naphthalenesulfonate-formalin condensate and a sodium, potassium, lithium or amine salt of petroleum or synthetic sulfonic acid; and (E) 10 to 70% by weight of water, each based on the total composition weight.

4 Claims, No Drawings

AQUEOUS WORKING LIQUID COMPOSITION FOR WIRE SAW

FIELD OF THE INVENTION

The present invention relates to a working liquid composition which is used with abrasive grains dispersed therein for slicing with a wire saw.

BACKGROUND OF THE INVENTION

A wire saw is used for slicing crystals such as silicon ingot, GaAs, GaP and the like, optical materials such as quartz glass, crystal and the like, and hard and brittle materials such as ceramics. Slicing with a wire saw is a technique in which wounded fine wire, such as piano wire, is continuously unwound and run onto a workpiece with loose abrasive grains, e.g., green silicon carbide (GC), dispersed in a working liquid being applied between the wire and the workpiece.

Taking slicing of a silicon ingot for instance, when a small-diameter silicon ingot having a diameter of 3 inches or less is sliced into wafers, an outer diameter blade is used. In slicing a silicon ingot of 3 inches or more in diameter, an inner diameter blade is used in order to prevent poor cut surface conditions due to deflection or vibration of the outer diameter blade. The inner diameter blade must have a kerf thickness of at least 0.5 mm so as to have high rigidity sufficient for ensuring parallelism of cut surfaces, which unavoidably involves a considerable kerf loss. On the other hand, since the wire of a wire saw can have a diameter of 0.2 mm or less and thus achieves an improved yield, use of a wire saw has recently been extending in slicing an ingot of 8 inches or more. Because a wire saw is not provided with a blade unlike an outer diameter or inner diameter slicing machine, it greatly matters how uniformly loose abrasive grains are to be applied between fine wire and a workpiece, and a working liquid effective for that purpose is required.

Conventional working liquids for slicing include non-aqueous compositions comprising low-viscous mineral oil containing fats and oils or an extreme pressure additive and aqueous compositions called "chemical type" comprising water containing an anticorrosive agent, e.g., benzoate, nonionic surface active agent, and glycol. While low-viscous working liquids sufficiently serve for blades with bonded abrasive grains, such as an outer diameter blade and an inner diameter blade, the viscosity structure of a working liquid is of great importance in those cases where loose abrasive grains serve as a blade as in wire saw slicing. That is, in order for loose abrasive grains to be sufficiently supplied to a workpiece, they should be stably dispersed in the liquid while in a feed tank, and the property of a working liquid and abrasive grains in holding onto the wire of a wire saw depends on the viscosity structure and adhesiveness of the working liquid. In recent years, a wire saw has undergone improvements in slicing speed and precision of cut surface profile of a sliced workpiece and has come to be used for slicing larger-diameter ingots, e.g., 12-inch ingots. With these tendencies, there has been a demand for improvements on not only machinery but the working liquid used therefor.

JP-A-4-216897 and JP-A-4-218594 (the term "JP-A" as used herein means an "unexamined published Japanese patent application") propose novel aqueous working liquid compositions mainly comprising glycols and water-soluble thickeners, but these compositions have now come to fail to meet the ever increasing market demands on total thickness valuation (TTV) and local thickness valuation (LTV). This is because of the difficulty in uniformly applying abrasive grains onto fine wire by use of a working liquid and lack of moderate lubricity. In order to apply abrasive grains to fine wire uniformly, it is necessary for the working liquid to have the abrasive grains dispersed therein stably and to exhibit uniform adhesion to fine wire. Furthermore, in order for the abrasive grains to perform an optimum cutting function, it is necessary for the working liquid to have moderate lubricity. While the dispersion stability of abrasive grains is dependent on the viscosity and surfactant character of a working liquid, a working liquid should have structural viscosity. Too much lubricity of a working liquid makes the abrasive grains slip without biting a workpiece, resulting in reduced cutting performance. On the other hand, lack of lubricity makes the individual abrasive grains incapable of exhibiting sufficient cutting performance.

JP-A-8-57847 discloses a composition mainly comprising a uniform mixture of organic or inorganic bentonite, water, and a fatty acid amine obtained by reacting an alkanolamine and a higher fatty acid as a working liquid for wire saw slicing; JP-A-8-60176 discloses a composition mainly comprising an aqueous bentonite dispersion having dissolved therein a reaction product between N-methyl-2-pyrrolidone and stearic acid, a reaction product between benzotriazole and oleic acid, and ethanolamine; and JP-A-8-57848 discloses a composition mainly comprising an aqueous solution of 2-methyl-1-stearoylimidazole and 2-methyl-1-oleylimidazole. In these compositions, bentonite serves as a crosslinking dispersant, improving the dispersibility of abrasive grains, and the imidazole compounds also make contribution to the dispersibility of abrasive grains. With reference to dispersion of abrasive grains by thickening by bentonite, JP-B-57-45794 (the term "JP-B" as used herein means an "examined Japanese patent publication") discloses a composition in which abrasive grains are dispersed by using organic bentonite which is a clathrate compound obtained by reacting bentonite and an organic amine. Thus, the effect of the combination of bentonite and amines on dispersibility of abrasive grains is known, but the effect is based on a thickening effect.

If dispersion of particles relies on only thickening, long-term stability of the structural viscosity based on the thickening is of great factor. In the case of wire saw slicing, micron-order precision of slice thickness and cut surface profile is demanded. To fulfil the demand, the abrasive grains must be dispersed in a working liquid with constantly stable dispersibility.

Thickening by bentonite is achieved as follows. Bentonite takes up certain kinds of strongly polar organic or inorganic substances among its lamellae to form an interlamellar compound, which is more easily swollen with water or other solvents to increase viscosity. Selection of the interlamellar compound is very important. If the choice is wrong, bentonite once swollen tends to re-agglomerate. In this connection, thickening by bentonite's including ethanolamine produces favorable results temporarily but is unsatisfactory in long-term stability. Thickening by imidazole compounds is also insufficient for dispersion stability.

On the other hand, cleanability after slicing has recently come up as a new requirement for a working liquid. A wafer sliced off with a wire saw is to be subjected to lapping. Having adhered thereto broken abrasive grains, the working liquid, and cutting dust, a wafer immediately after slicing cannot be transferred as such to a lapping step where strict surface precision is demanded. Hence, the wafer has been cleaned with cleaning chemicals. However, use of organic solvents and the like that have been permitted as cleaning chemicals is now being restricted for their carcinogenicity or under restrictions on waste disposal. Therefore there has been a market demand for a technique that makes it possible to clean a wafer after slicing only with water without adding any cleaning chemicals.

SUMMARY OF THE INVENTION

An object of the present invention is to provide an aqueous working liquid composition for slicing with a wire saw which, with abrasive grains dispersed therein, stably exhibits excellent performance in slicing with a wire saw and makes it feasible to remove abrasive grains, cutting dust of a workpiece and the working liquid (oil agent) from the sliced workpiece by cleaning with water.

This and other objects of the present invention have been accomplished by an aqueous working liquid composition for a wire saw comprising the following components (A) to (E):

(A) 10 to 60% by weight of at least one polyglycol ether represented by the following formula (I) or (II):

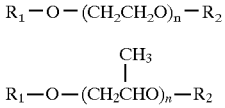

$$R_1-O-(CH_2CH_2O)_n-R_2 \quad (I)$$

$$R_1-O-(CH_2\overset{\overset{\displaystyle CH_3}{|}}{C}HO)_n-R_2 \quad (II)$$

wherein $R_1$ represents a hydrogen atom, an alkyl group having 1 to 6 carbon atoms or a phenyl group;

$R_2$ represents a hydrogen atom or an acetyl group; and n represents an integer of 1 to 4;

(B) 0.1 to 5.0% by weight of at least one selected from the group consisting of organic bentonite and inorganic bentonite;

(C) 0.01 to 5.0% by weight of at least one selected from the group consisting of carboxymethyl cellulose (CMC), MgO, methanol, and ethanol;

(D) 0.1 to 2.0% by weight of at least one selected from the group consisting of a sodium β-naphthalenesulfonate-formalin condensate and a sodium, potassium, lithium or amine salt of petroleum or synthetic sulfonic acid; and (E) 10 to 70% by weight of water, each based on the total composition weight.

DETAILED DESCRIPTION OF THE INVENTION

The composition comprising components (A) to (E) may contain 0.5 to 10.0% by weight, based on the total composition weight, of a water-soluble phosphorus compound represented by the following formula (III) or (IV):

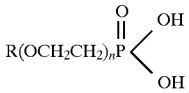

$$R(OCH_2CH_2)_nP(=O)(OH)_2 \quad (III)$$

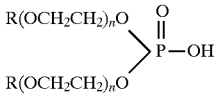

$$[R(OCH_2CH_2)_nO]_2P(=O)-OH \quad (IV)$$

wherein R represents an alkyl group having 1 to 18 carbon atoms or a phenyl group; and n represents an integer of 2 to 5, the water-soluble phosphorus compound being neutralized to a pH of 6 to 10 with at least one alkaline agent selected from the group consisting of sodium hydroxide, potassium hydroxide, lithium hydroxide, monoethanolamine, diethanolamine, and triethanolamine.

The composition comprising components (A) to (E) may further contain at least one selected from the group consisting of (a) 1.0 to 10.0% by weight of at least one amide compound represented by the following formula (V) or (VI):

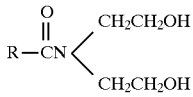

$$R-C(=O)N(CH_2CH_2OH)_2 \quad (V)$$

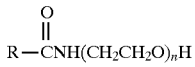

$$R-C(=O)NH(CH_2CH_2O)_nH \quad (VI)$$

wherein R represents a saturated or unsaturated fatty acid having 10 to 18 carbon atoms or a coconut oil fatty acid; and n represents an integer of 2 to 6;

(b) 2 to 50% by weight of at least one fatty acid salt represented by the following formula (VII):

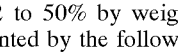

$$R\text{-}COO.M \quad (VII)$$

wherein R represents a saturated or unsaturated fatty acid having 10 to 18 carbon atoms or a coconut oil fatty acid; and M represents sodium, potassium, lithium or an amine residue; and (c) 0.1 to 5.0% by weight of boric acid, each based on the total composition weight.

The constituent components which can be used in the aqueous working liquid composition of the present invention will be described specifically.

The polyglycol ethers as component (A), represented by formula (I) or (II), serve as a base material in the present invention. More specifically, the polyglycol ethers are water-soluble glycol ethers such as ethylene glycol monomethyl ether, diethylene glycol monomethyl ether, propylene glycol monomethyl ether, dipropylene glycol monomethyl ether, ethylene glycol monobutyl ether, diethylene glycol monobutyl ether, and propylene glycol monobutyl ether. Those of commercially available product grade or higher grade are preferably used. Component (A) is used in an amount of 10 to 60% by weight based on the total composition weight. The proportion of component (A) is decided within this range depending on the other components. If it is less than 10% by weight, dispersibility of abrasive grains in the composition and uniform adhesion of abrasive grains to wire are deteriorated. If it exceeds 60% by weight, the proportion of the other components is insufficient for securing cutting performance.

In addition to the above-mentioned glycol ether compounds, water-soluble glycol solvents, such as ethylene glycol, polyethylene glycol (e.g., diethylene glycol), polyoxyethylene glycol, and a copolymer of polyoxyethylene glycol and polyoxypropylene glycol, can be used in combination.

The organic or inorganic bentonite as component (B) includes crystalline montomorillonite per se (i.e., inorganic bentonite) and a composite of montomorillonite and an organic base (i.e., organic bentonite). These bentonite species should have a purity of not lower than 90%. Low purity inorganic bentonite contains quartz, mudstone, and the like. Low purity organic bentonite, which is prepared from low purity inorganic bentonite, may also contain such impurities. When applied to wire saw slicing demanding high precision as in slicing of semiconductors, a working liquid containing such impurity-containing bentonite fails to achieve performance as desired. Component (B) is used in an amount of 0.1 to 5.0% by weight based on the total composition weight. If it is less than 0.1% by weight, sufficient viscosity for stable dispersion of abrasive grains is not obtained. If it exceeds 5.0% by weight, the viscosity becomes too high for the resulting composition to be mixed with abrasive grains and for a working liquid prepared therefrom to be smoothly fed to a workpiece.

Component (C) selected from the group consisting of CMC, MgO, methanol, and ethanol is used as an accelerator for bentonite swelling. It is used in an amount of 0.01 to 5.0% by weight based on the total composition weight. If it is less than 0.01% by weight, the effect on bentonite swelling is weak. If it exceeds 5.0% by weight, the effect on bentonite swelling is ruined.

A sodium β-naphthalenesulfonate-formalin condensate or a salt of petroleum or synthetic sulfonic acid (Na, K, Li or amine salt) as component (D) is effective in improving the dispersibility of abrasive grains and, at the same time, produces a synergistic effect with component (C), such as CMC, MgO, methanol, and ethanol, on stable bentonite swelling. That is, component (D) exhibits excellent effects in stably dispersing abrasive grains in the composition and supplying the abrasive grains to the wire of a wire saw. Component (D) is used in an amount of 0.1 to 2.0% by weight based on the total composition weight. If it is less than 0.1% by weight, the performance on dispersion of abrasive grains is insufficient. Presence of more than 2.0% by weight of component (D) interferes with bentonite in swelling.

Water as component (E) is added in an amount of 10 to 70% by weight, preferably 28 to 70% by weight, based on the total composition weight.

The phosphorus compound represented by formula (III) or (IV) has an oxyethylene group to obtain water-solubility, and has been adjusted to a pH of 6 to 10 with at least one alkaline agent selected from the group consisting of sodium hydroxide, potassium hydroxide, lithium hydroxide, monoethanolamine, diethanolamine, and triethanolamine. This component can be added to improve cutting performance of a wire saw, bringing improved surface precision of a wafer in terms of TTV. It is preferably added in an amount of 0.5 to 10.0% by weight based on the total composition weight. Addition of less than 0.5% by weight produces no substantial effect. If it exceeds 10.0% by weight, the component adversely affects anticorrosion of a wire saw and dispersibility of abrasive grains.

The amide compound represented by formula (V) or (VI) has a thickening effect to improve dispersibility of abrasive grains and an effect of improving lubricity in slicing. Specific examples of the amide compounds include fat and oil fatty acid (e.g, coconut oil fatty acid) diethanolamide, saturated fatty acid (e.g., lauric acid) diethanolamide, unsaturated fatty acid (e.g., oleic acid) diethanolamide, and polyoxyethylene coconut oil fatty acid monoethanolamide. The amide compound is preferably added in an amount of 1.0 to 10.0% by weight based on the total composition weight. Addition of less than 1% of the amide compound produces no appreciable effect. Addition of more than 10% by weight results in too much thickening, which impairs slicing stability.

The fatty acid salt brings about a lubricating effect in wire saw slicing. It is preferably added in an amount of 2 to 50% by weight based on the total composition weight. Addition of less than 2% by weight of the fatty acid salt produces no appreciable effect. Addition of more than 50% by weight destroys the viscosity balance, resulting in various troubles.

Boric acid has an anticorrosive effect and also serves to adjust the pH of the composition thereby to hold the viscosity balance. Species having at least a purity for chemical use are preferred. It is preferably used in an amount of 0.1 to 5.0% by weight based on the total composition weight. If it is less than 0.1% by weight, no apparent effect is produced. Addition of more than 5% by weight of boric acid hinders the thickening effect of bentonite.

In order to ensure anticorrosion of a wire saw and its wire, it is preferred to further add to the composition of the present invention at least one water-soluble anticorrosive agent, such as benzotriazole, benzothiazole, and sodium mercaptobenzothiazole. These anticorrosive agents are preferably added in a total amount of 0.01 to 1.0% by weight. Addition of less than 0.01% by weight is insufficient for anticorrosion. Even if it is more than 1.0% by weight, the effect reaches saturation, resulting in nothing but bad economy.

For preventing generation of mould or bacteria causing putrefaction during storage or while running, it is preferred to add to the composition of the present invention commercially available water-soluble antiseptics, such as thiazole compounds, imidazole compounds, cresol compounds, triazine compounds, quaternary ammonium salts, and biguanide compounds. The antiseptic is preferably added in an amount of 0.01 to 1.0% by weight based on the total composition weight. If it is less than 0.01% by weight, the antiseptic effect is insubstantial. Addition of more than 1.0% by weight of the antiseptics adversely affects the swellability of bentonite.

If desired, the composition of the present invention may further contain various additives commonly employed in the art for enhancing the effects and workability of the composition. For example, oiliness improvers, such as fats and oils; extreme pressure additives, such as chlorine, sulfur or phosphorus; and defoaming agents, such as silicone, can be added.

Abrasive grains are stably dispersed in the working liquid and uniformly adhered to fine wire to perform the function of cutting a workpiece satisfactorily. After slicing a workpiece, the abrasive grains, cutting dust, and the working liquid adhered to the sliced workpiece can easily be removed by cleaning with water.

The constitution and effects of the present invention will now be illustrated in greater detail by way of Examples in contrast with Comparative Examples, but it should be understood that the present invention is not construed as being limited thereto. All percents, parts, ratios and the like are given by weight unless otherwise indicated.

EXAMPLES 1 TO 6 AND COMPARATIVE EXAMPLES 1 TO 4

Working liquid compositions according to the present invention were prepared in accordance with the formulations shown in Table 1. For comparison, working liquid compositions were prepared in accordance with the formulations shown in Table 2 (formulations of commercial products). The details of the materials used in Examples and Comparative Examples are shown in Tables 1 and 2.

TABLE 1

| | Ex. 1 | Ex. 2 | Ex. 3 | Ex. 4 | Ex. 5 | Ex. 6 |
|---|---|---|---|---|---|---|
| Basic Components (%): | | | | | | |
| (A) Polyglycol ether | 40.00[1)] | 40.00[1)] | 10.00[1)] | 60.00[3)] | 40.00[1] | 40.00[2)] |
| (B) Bentonite | 0.90[4)] | 0.90[4] | 3.50[4)] | 3.50[4)] | 0.90[5)] | 0.10[4)] |
| (C) CMC | — | — | 0.01 | — | — | — |
| (C) MgO | 0.01 | 0.01 | — | — | — | 0.01 |
| (C) Methanol | — | — | — | 5.00 | — | — |
| (C) Ethanol | — | — | — | — | 1.00 | — |
| (D) Sodium β-naphthalene sulfonate-formalin condensate or salt of petroleum or synthetic sulfonic acid | 0.50[6)] | 0.50[6)] | 0.10[7)] | 2.00[7)] | 0.50[6)] | 0.50[6)] |
| *Water-soluble anticorrosive agent | 0.50[8)] | 0.50[8)] | 0.10[9)] | 1.00[9)] | 0.50[8)] | 0.50[8)] |
| *Water-soluble antiseptic | 0.05[10)] | 0.05[10)] | 0.10[11)] | 0.50[10)] | 0.05[10)] | 0.05[10)] |
| (E) Water | 58.04 | 58.04 | 86.19 | 26.50 | 57.05 | 58.84 |
| Total | 100.00 | 100.00 | 100.00 | 100.00 | 100.00 | 100.00 |
| Basic components above (part) | 100.0 | 97.00 | 88.10 | 90.00 | 99.50 | 87.50 |
| Monovalent metal or amine salt of water-soluble phosphorus compound (part) | | 3.00[12)] | | 10.00[12)] | 0.50[12)] | |
| Amide compound (part) | | | 5.50[13)] | | | 10.00[13)] |
| Fatty acid salt (part) | | | 6.00[14)] | | | 2.00[14)] |
| Boric Acid (part) | | | 0.40 | | | 0.50 |

TABLE 2

| | Compara. Ex. 1 | Compara. Ex. 2 | Compara. Ex. 3 | Compara. Ex. 4 |
|---|---|---|---|---|
| Glycol | 50.0[15)] | | | |
| Polysaccharide | 0.1[16)] | | | |
| Water | 49.9 | | | |
| Mineral oil | | 95.0[17)] | 92.0[18)] | 66.6[19)] |
| Fatty acid | | 1.0[20)] | | 1.0[21)] |
| Fats and oils | | 4.0[22)] | 5.0[23)] | |
| Chlorinated paraffin | | | 2.0[24)] | |
| Sulfated fats and oils | | | 1.0[25)] | |
| Bentonite | | | | 8.4[26)] |
| Nonionic surfactant | | | | 15.0[27)] |

Abrasive grains (green silicon carbide #600) and the working liquid were mixed at a weight ratio of 1:1, and the mixture was stirred at 1500 rpm. A piece of wire having a diameter of 0.16 mm and a length of 100 mm was dipped in the mixture while stirring, immediately taken out, and hung vertically for 5 minutes to let excessive liquid drop. The state of adhesion of the abrasive grains to the wire was observed under a microscope. The results obtained are shown in Table 3.

TABLE 3

| | Example No. | | | | | | Comparative Example No. | | | |
|---|---|---|---|---|---|---|---|---|---|---|
| | 1 | 2 | 3 | 4 | 5 | 6 | 1 | 2 | 3 | 4 |
| Evaluation | A | A | A | A | A | A | C | C | C | B |

Standard of Evaluation:
A . . . The abrasive grains uniformly adhere to 90 to 100% of the wire surface.

TABLE 3-continued

| | Example No. | | | | | | Comparative Example No. | | | |
|---|---|---|---|---|---|---|---|---|---|---|
| | 1 | 2 | 3 | 4 | 5 | 6 | 1 | 2 | 3 | 4 |

B . . . The abrasive grains uniformly adhere to 70 to 90% of the wire surface.
C . . . The abrasive grains adhere to less than 70% of the wire surface.

As apparent from Table 3, when a working liquid having the composition according to the present invention is used, the abrasive grains adhere to 90 to 100% of the wire surface uniformly.

The working liquids prepared were tested in slicing a single crystal of silicon having a diameter of 300 mm and a length of 200 mm with a wire saw (Model 444, manufactured by Nippei Toyama Corporation) under the following conditions. The results are shown in Table 4.

Slicing Conditions:

Workpiece: Si single crystal; 300 mm in diameter and 200 mm in length

Average cutting speed: 0.33 mm/min

Wire diameter (before use): 0.180 mm

Abrasive grains: green silicon carbide #600

Abrasive grains/working liquid: 1/1 by weight

TABLE 4

| | Example No. | | | | | | Comparative Example No. | | | |
|---|---|---|---|---|---|---|---|---|---|---|
| | 1 | 2 | 3 | 4 | 5 | 6 | 1 | 2 | 3 | 4 |
| TTV | 10 | 15 | 17 | 15 | 15 | 17 | 25 | 21 | 30 | 20 |

Note: TTV: total thickness valuation observed on a single wafer sliced off.

As can be seen from Table 4, the total thickness valuation can be reduced by using the working liquids having the composition according to the present invention.

Each of the resulting wafers shown in Table 4 was thoroughly cleaned with running tap water on both sides thereof. The surface of the cleaned wafer was observed with the naked eye. The results are shown in Table 5.

TABLE 5

| | Example No. | | | | | | Comparative Example No. | | | |
|---|---|---|---|---|---|---|---|---|---|---|
| | 1 | 2 | 3 | 4 | 5 | 6 | 1 | 2 | 3 | 4 |
| Cleanability | A | A | A | A | A | A | C | C | C | C |

Standard of Evaluation:
A . . . Abrasive grains, cutting dust, and the working liquid have been completely removed, and no contaminant is observed with the naked eye.
C . . . Abrasive grains, cutting dust, and the working liquid have been removed to some extent, but contaminants are still observed with the naked eye.

As apparent from Table 5, when the working liquid according to the present invention is used, the abrasive grains, cutting dust, and the working liquid can be removed completely, leaving no contaminants perceptible with the naked eye.

While the invention has been described in detail and with reference to specific examples thereof, it will be apparent to one skilled in the art that various changes and modifications can be made therein without departing from the spirit and scope thereof.

This application is based on application No. Hei 8-212720 filed in Japan, the content of which is incorporated hereinto by reference.

What is claimed is:

1. An aqueous working liquid composition for a wire saw comprising the following components (A) to (E):

(A) 10 to 60% by weight of at least one polyglycol ether represented by the following formula (I) or (II):

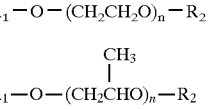

$$R_1-O-(CH_2CH_2O)_n-R_2 \quad (I)$$

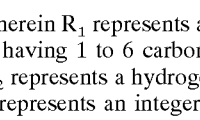

$$R_1-O-(CH_2\overset{\overset{CH_3}{|}}{C}HO)_n-R_2 \quad (II)$$

wherein $R_1$ represents a hydrogen atom, an alkyl group having 1 to 6 carbon atoms or a phenyl group;

$R_2$ represents a hydrogen atom or an acetyl group; and n represents an integer of 1 to 4;

(B) 0.1 to 5.0% by weight of at least one selected from the group consisting of organic bentonite and inorganic bentonite;

(C) 0.01 to 5.0% by weight of at least one selected from the group consisting of carboxymethyl cellulose (CMC), MgO, methanol, and ethanol;

(D) 0.1 to 2.0% by weight of at least one selected from the group consisting of a sodium β-naphthalenesulfonate-formalin condensate and a sodium, potassium, lithium or amine salt of petroleum or synthetic sulfonic acid; and (E) 10 to 70% by weight of water, each based on the total composition weight.

2. The aqueous working liquid composition as claimed in claim 1, which further contains 0.5 to 10.0% by weight, based on the total composition weight, of a water-soluble phosphorus compound represented by the following formula (III) or (IV):

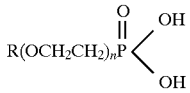

$$R(OCH_2CH_2)_nP(=O)(OH)_2 \quad (III)$$

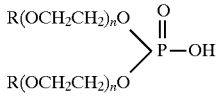

$$[R(OCH_2CH_2)_nO]_2P(=O)-OH \quad (IV)$$

wherein R represents an alkyl group having 1 to 18 carbon atoms or a phenyl group; and n represents an integer of 2 to 5, the water-soluble phosphorus compound being neutralized to a pH of 6 to 10 with at least one alkaline agent selected from the group consisting of sodium hydroxide, potassium hydroxide, lithium hydroxide, monoethanolamine, diethanolamine, and triethanolamine.

3. The aqueous working liquid composition as claimed in claim 1, which further contains at least one selected from the group consisting of (a) 1.0 to 10.0% by weight of at least one amide compound represented by the following formula (V) or (VI):

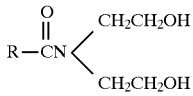

$$R-C(=O)N(CH_2CH_2OH)_2 \quad (V)$$

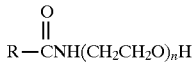

$$R-C(=O)NH(CH_2CH_2O)_nH \quad (VI)$$

wherein R represents a saturated or unsaturated fatty acid having 10 to 18 carbon atoms or a coconut oil fatty acid; and n represents an integer of 2 to 6;

(b) 2 to 50% by weight of at least one fatty acid salt represented by the following formula (VII):

$$R-COO.M \quad (VII)$$

wherein R represents a saturated or unsaturated fatty acid having 10 to 18 carbon atoms or a coconut oil fatty acid; and M represents sodium, potassium, lithium or an amine residue; and (c) 0.1 to 5.0% by weight of boric acid, each based on the total composition weight.

4. The aqueous working liquid composition as claimed in claim 1, which further contains:

(i) 0.01 to 1.0% by weight of at least one water-soluble anticorrosive agent selected from the group consisting of benzothiazole, benzotriazole and sodium mercaptobenzothiazole; and (ii) 0.01 to 1.0% by weight of at least one water-soluble antiseptic selected from the group consisting of imidazole compounds, cresol compounds, triazine compounds, quaternary ammonium salts, and biguanide compounds.

* * * * *